US008342776B2

(12) United States Patent
Watson et al.

(10) Patent No.: US 8,342,776 B2
(45) Date of Patent: Jan. 1, 2013

(54) MINE SEAL WITH ADHESIVE

(75) Inventors: George Anthony Watson, Prosperity, PA (US); David A. Hussey, Glenwood Springs, CO (US); Stephen Gerard Sawyer, McMurray, PA (US)

(73) Assignee: Micon, Pittsburgh, PA (US)

( * ) Notice: Subject to any disclaimer, the term of this patent is extended or adjusted under 35 U.S.C. 154(b) by 0 days.

(21) Appl. No.: 12/134,679

(22) Filed: Jun. 6, 2008

(65) Prior Publication Data

US 2009/0010715 A1 Jan. 8, 2009

Related U.S. Application Data

(60) Provisional application No. 60/933,555, filed on Jun. 7, 2007.

(51) Int. Cl.
*E21D 9/00* (2006.01)

(52) U.S. Cl. ..... 405/147; 405/144; 405/152; 299/12

(58) Field of Classification Search ..... 405/132, 405/144, 147, 150.1, 152; 299/12; 454/169
See application file for complete search history.

(56) References Cited

U.S. PATENT DOCUMENTS

| | | | | |
|---|---|---|---|---|
| 2,188,694 | A | 1/1940 | Tucker | |
| 3,240,736 | A * | 3/1966 | Beckwith | 524/2 |
| 4,516,879 | A | 5/1985 | Berry et al. | |
| 4,940,360 | A | 7/1990 | Weholt | |
| 5,009,048 | A * | 4/1991 | Paul | 52/308 |
| 5,385,504 | A | 1/1995 | Hussey et al. | |
| 5,725,327 | A | 3/1998 | Hussey et al. | |
| 5,951,796 | A | 9/1999 | Murray | |
| 6,422,790 | B1 | 7/2002 | Damron | |
| 6,425,820 | B1 | 7/2002 | Kennedy et al. | |
| 6,457,906 | B1 * | 10/2002 | Kennedy et al. | 405/151 |
| 6,662,516 | B2 | 12/2003 | Vandehey et al. | |
| 6,955,502 | B2 | 10/2005 | Warren | |
| 2002/0021042 | A1 * | 2/2002 | Damron | 299/12 |
| 2005/0096411 | A1 | 5/2005 | Molla | |
| 2005/0115185 | A1 | 6/2005 | Telford et al. | |

FOREIGN PATENT DOCUMENTS

EP 0927234 B1 6/2001

OTHER PUBLICATIONS

D.T. Kirkwood; K.K. Wu; Technical Considerations for the Design and Construction of Mine Seals to Withsatnd Hydraulic Heads in Underground Mines; Jan. 1, 1995.*

* cited by examiner

*Primary Examiner* — David Bagnell
*Assistant Examiner* — Benjamin Fiorello
(74) *Attorney, Agent, or Firm* — The Webb Law Firm

(57) ABSTRACT

An explosive-resistant mine seal, which includes a pair of block walls. An adhesive is provided between adjoining surfaces of the blocks where the adhesive has greater strength properties than the blocks themselves. A core member is provided between the two walls and is bound thereto. The adhesive may be coated over the walls to increase the strength of the mine seal.

29 Claims, 7 Drawing Sheets

MINE SEAL WITH ADHESIVE

CROSS-REFERENCE TO RELATED APPLICATION

This application claims the benefit of U.S. Provisional Application No. 60/933,555, filed Jun. 7, 2007, the entire contents of which is hereby incorporated by reference.

BACKGROUND OF THE INVENTION

1. Field of the Invention

The present invention relates to permanent isolation seals for mining applications and, more particularly, to a permanent seal in an underground entry to isolate the atmosphere on one side of the seal from the atmosphere on the other side.

2. Description of Related Art

In underground mining, there is typically a need to isolate the atmosphere in a specific portion of the mine. A seal is provided to isolate areas of the mine for purposes such as to limit the area of the mine workings that need to be ventilated, to control the dissemination of any toxic or explosive gases in the mine, or to allow the atmosphere in an isolated part of the mine to change its composition to a less hazardous state. Seals are constructed across individual mining entries or tunnels to provide such isolation.

Seals have been traditionally constructed as walls of stacked concrete blocks that may be coated or joined together with a cementitious material, which is considerably weaker than the concrete blocks themselves. Further, the cementitious material typically shrinks over time creating leaks in the seal and possibly allowing dangerous gases to bypass the seal. Blocks are fitted across a mine opening in a staggered or overlapping relationship. Such seals, however, have not been found to withstand mine explosion overpressures of over 20 psi. More recently, a mine seal has been employed that incorporates concrete block walls sandwiching an inner core of a polymeric material containing aggregate. This composite structure of a core provided between two concrete block walls (described in U.S. Pat. No. 5,385,504, incorporated herein by reference), is constructed by dry-stacking concrete blocks to form walls between the roof, floor and ribs of a mine entry. A rear wall is first constructed and wedged into place. Next, a front wall is constructed to a height of 2-3 feet and construction continues by pyramiding the blocks until one or two blocks are in contact with the roof. The core material is installed between the fully constructed rear wall and the partially constructed front wall by providing a layer of aggregate material (gravel or the like) between the walls and coating the aggregate material with foamable polyurethane. As the polyurethane foams and cures, the polyurethane increases in height (with the aggregate mixed therein) and solidifies, adhering to the rear and front walls. Construction of the front wall continues and additional layers of the core material (polyurethane and aggregate) are provided between the rear wall and the growing front wall until the core material and the front wall reach the roof of the mine entry. The outside surface of the front wall is covered with a coating of a fire-resistant sealant satisfying the guidelines of the Mine Safety and Health Administration (MSHA). While this composite seal withstands mine explosion overpressures of at least 20 psi, a need has been identified to increase the pressure rating of mine seals.

SUMMARY OF THE INVENTION

This need is met by the mine seal of the present invention that includes a pair of walls, each wall including a plurality of blocks and a core provided between the walls and adhering to the walls. An adhesive is provided between adjoining surfaces of the blocks of the walls. The sealant has greater strength properties than the blocks. The main seal may further include at least one internal wall to provide additional strengthening of the seal. The present invention also includes a method of strengthening a wall that includes a plurality of blocks by providing a plurality of individual blocks, coating a surface of each block with an adhesive and stacking the blocks to form a wall with the adhesive being positioned between adjoining surfaces of the blocks, wherein the adhesive has greater strength properties than the individual blocks.

DESCRIPTION OF THE INVENTION

Figure 1:
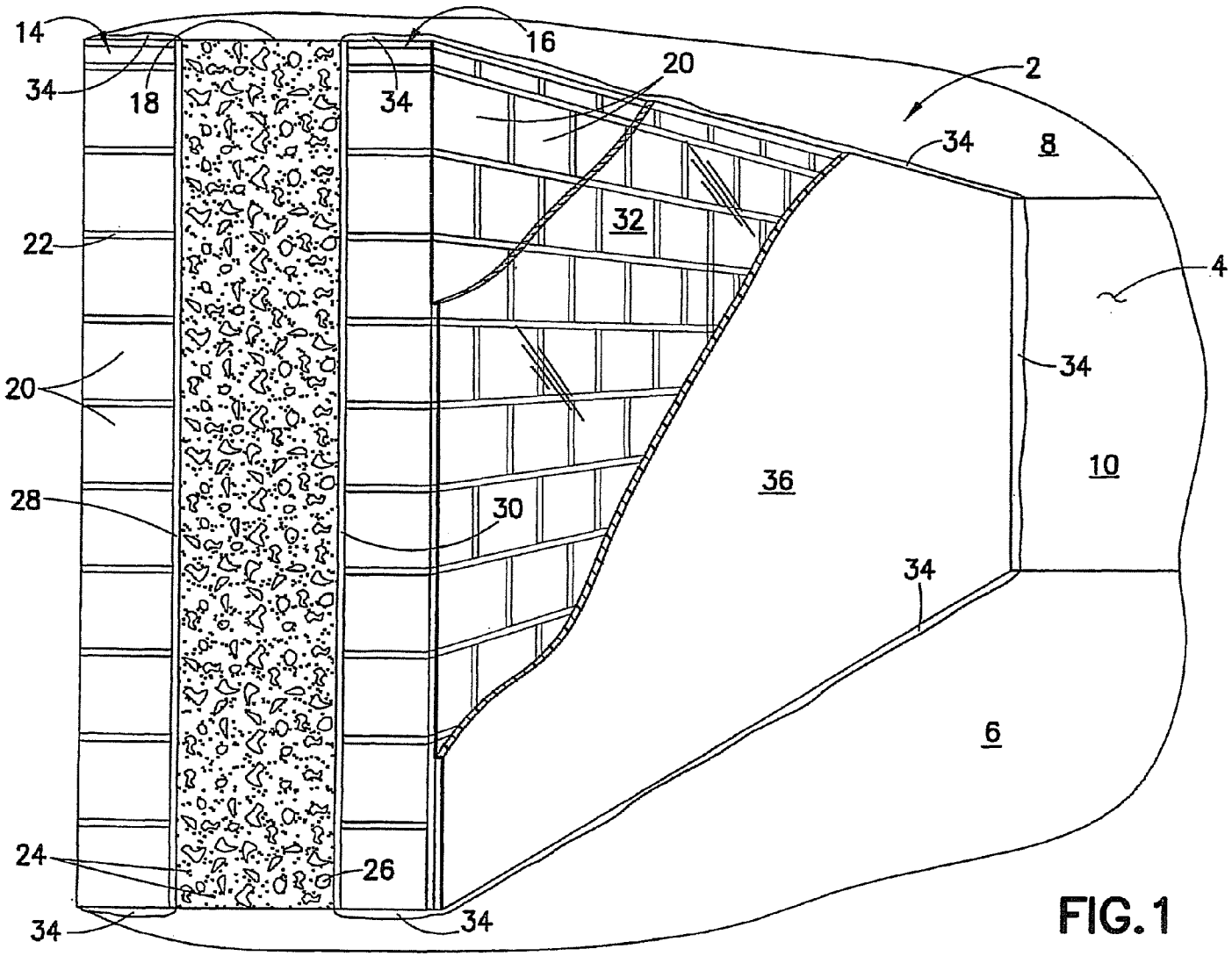
FIG. 1 is a perspective view of a constructed seal of the present invention, shown partially in section.
Figure 2:
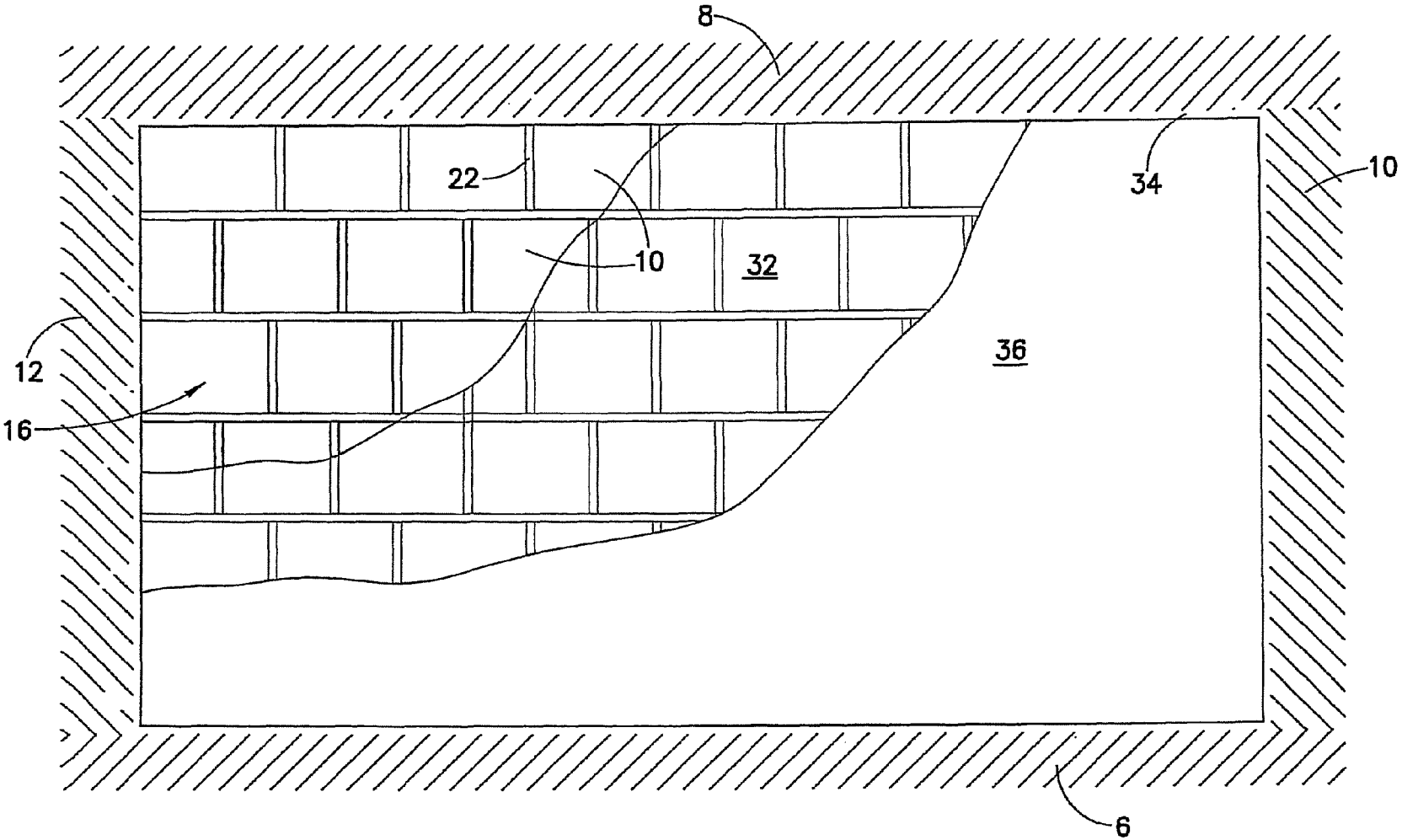
FIG. 2 is an elevational view of the front wall of the mine seal of the present invention installed in a mine entry.

Referring to FIGS. 1 and 2, the present invention is directed to an explosion-resistant mine seal 2 spanning a mine entry 4 defined by a floor 6, roof 8 and pillars 10, 12. The seal 2 includes a rear composite block wall 14 and a front composite block wall 16, both spanning the mine entry 4 with a core member 18 sandwiched therebetween. The walls 14, 16 are composed of a plurality of blocks 20, such as masonry blocks, adhered together via an adhesive 22. By masonry blocks, it is meant blocks of common construction such as blocks of brick, stone or concrete, but the material of the blocks is not limited thereto. The adhesive 22 is provided between the adjoining surfaces of the blocks 20 in a generally fluidized or flowable form, which cures shortly after its application to the blocks 20, e.g., within 30 seconds. In this manner, the adhesive 22 acts as a mortar between the blocks 20 of the walls 14, 16. One non-limiting example of a suitable composition for the adhesive 22 is a polyurethane provided as RokLok® 70 available from Micon, Inc. of Glassport, Pa. By using a rapid curing adhesive, the composite wall 14, 16 may be quickly constructed. For example, by the time one course of blocks 20 is laid with adhesive 22 therebetween, the adhesive 22 has cured so that the next course of blocks 20 is laid onto the just-constructed composite course of blocks 20 and adhesive 22. Other polymeric adhesives may be used to produce the composite walls 14, 16 according to the present invention. The composite block walls 14, 16 used in the seal 2 of the present invention have greater strength properties than the blocks 20 themselves or a conventional seal wall constructed by dry stacking the blocks 20. Accordingly, the strongest portion of the composite walls 14, 16 is the adhesive 22 between the blocks 20. Properties that are important to the strength of the composite walls 14, 16 include the compressive strength, flexural strength, shear strength and tensile strength. To construct composite walls 14, 16 for use in the seal 2 of the present invention, these strength properties for the adhesive 22 should be greater than the corresponding properties in the blocks 20. In this manner, the composite walls 14, 16 exhibit strength properties in excess of the strength properties of the blocks 20 themselves.

The strength of the seal 2 may be enhanced by including an adhesive layer on one or more surfaces of the composite walls 14, 16, such as surface layers 28, 30 on respective walls 14, 16 facing the core member 18 and/or front surface layer 32 on front wall 16. It should be understood that the thickness of the layers 28, 30, 32 and the thickness of the adhesive 22 between the blocks 20 are exaggerated in the drawings for illustration and may be selected based on the design parameters for the strength requirements of a particular installation of the seal 2. Referring to FIG. 4A, the seal 2 may further include, in addition to the rear composite block wall 14, the front composite block wall 16, and the core member 18, one or more interior walls 15 (such as a solid concrete block wall as described herein with respect to walls 14, 16) to provide additional strengthening of the seal. Additional core members 18 may be provided between each interior wall 15 and between each interior wall 15 and the walls 14, 16.

Additional adhesive 22 may be provided between walls 14, 16 and the surfaces of the mine entry 4 as at 34. This additional adhesive 34 can fill in gaps between the walls 14, 16 and floor 6, roof 8 and pillars 10, 12, particularly in rough mine entries. Additional adhesive 34 also serves to bind the seal 2 to the mine entry surfaces and increase the integrity of the seal 2 as the adhesive 34 seeps into cracks in the entry surfaces and cures therein. The exposed surface of front wall 16 or front surface layer 32 may be coated with a conventional MSHA-approved fire-resistant sealant layer 36.

The core member 18 provided between any two walls may be produced from a binding material 24, such as a foamable polyurethane (e.g., RokLok® 10 available from Micon, Inc.). A foamable polyurethane expands upon curing to produce a network of closed cell foam that fills in any void spaces between the two composite block walls 14, 16. Other binding materials may be used, such as plastics, polymeric foams and synthetic foams. The core member 18 binds to both composite block walls 14, 16, thereby creating an integral seal. The core member 18 may include aggregate material 26 (such as gravel, limestone, talc, glass, or other inert filler particulates). The aggregate material 26 is used in combination with the binding material 24 to increase the strength of the core member 18 at minimal expense. The proportion of aggregate material 26 to binding material 24 may be adjusted to ensure sufficient binding of the core member 18 to the composite block walls 14, 16.

Figure 3:
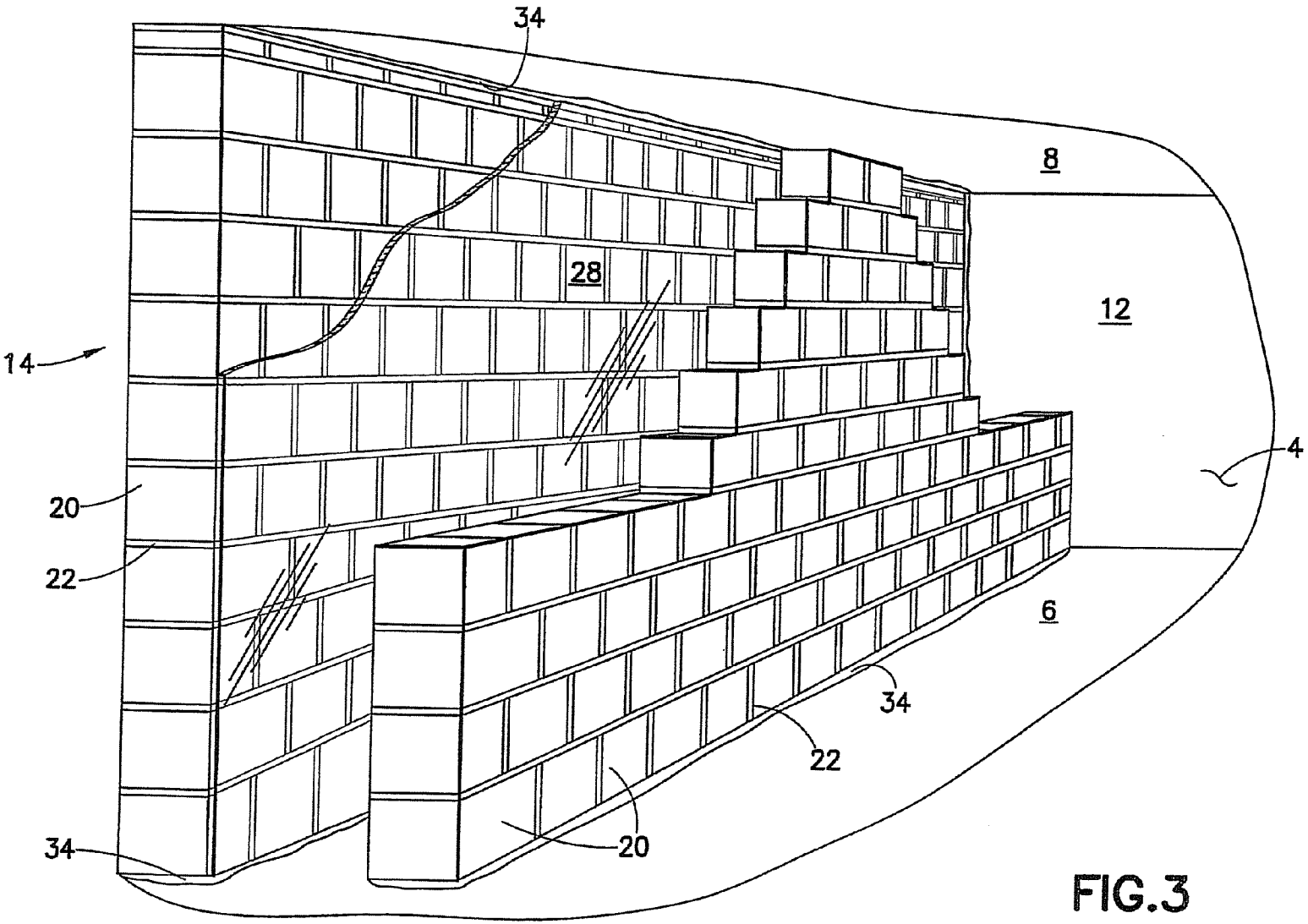
FIG. 3 is a perspective view of a first stage of constructing the mine seal of the present invention.
Figure 4:
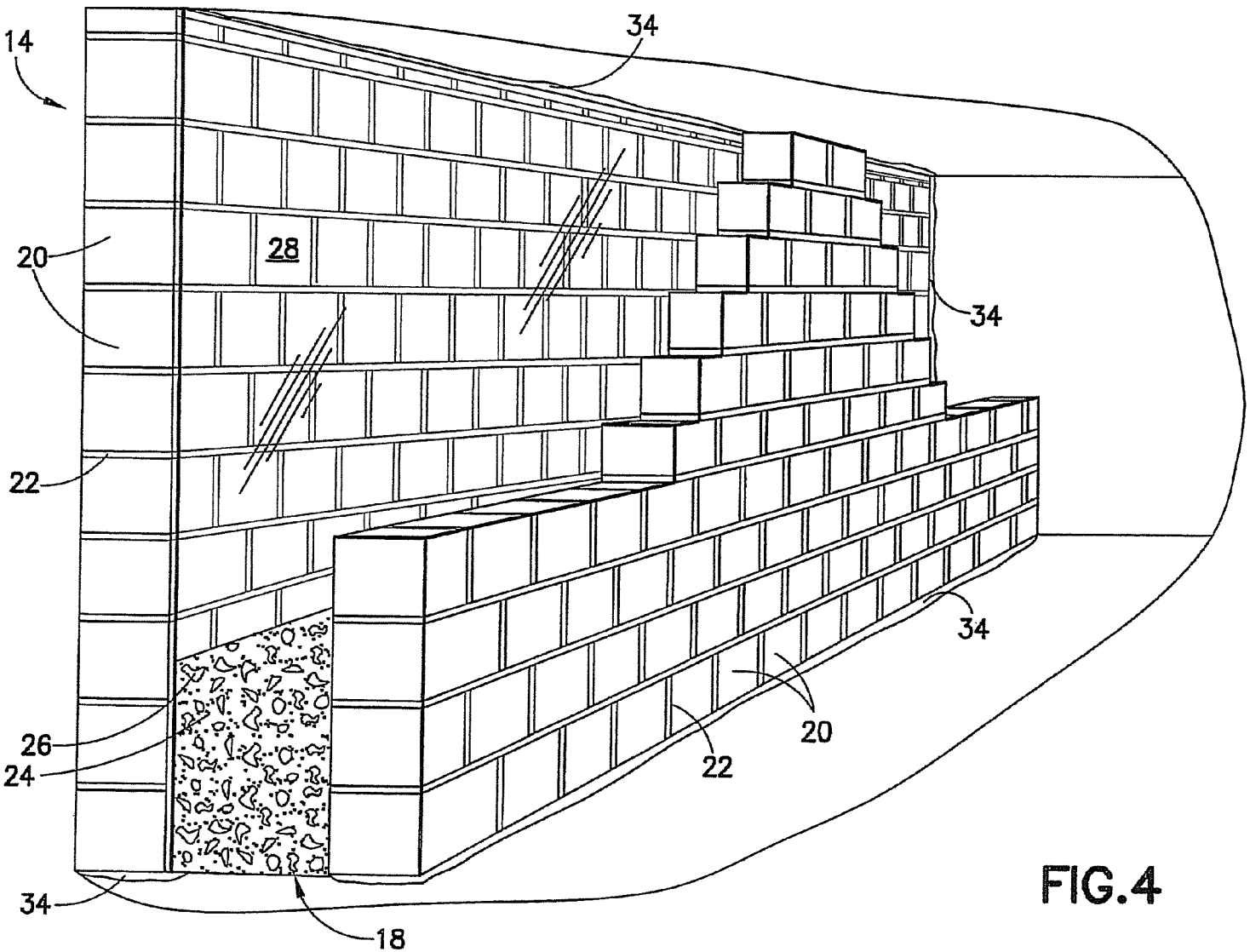
FIGS. 4 and 4A are perspective views of second stages of constructing a mine seal of the present invention.
Figure 4A:
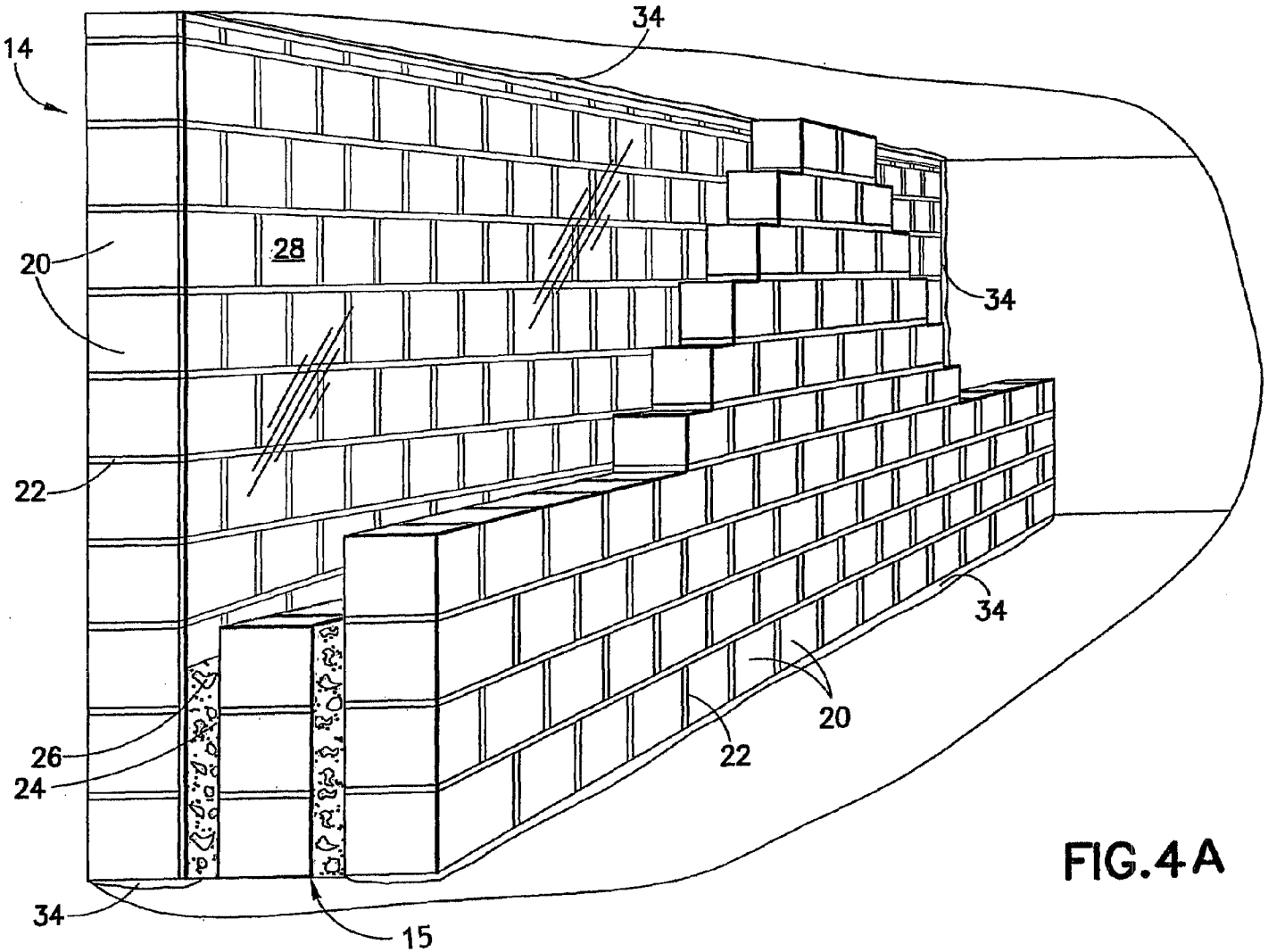

FIGS. 3-4 show a method of constructing the mine seal of the present invention. The seal 2 is produced by first constructing the rear wall 14 from a plurality of blocks 20, such as concrete blocks arranged in an overlapping manner. As the backside of the rear wall 14 (not shown) is constructed, a coating of a fire-retardant sealant may be applied thereto. A first course of concrete blocks are laid across the mine floor between the mine pillars 10, 12. The end surfaces of adjoining blocks 20 are coated with the adhesive 22. The adhesive 22 may be provided as a curable resin with a curing agent that is maintained separate until application to the blocks 20 via a delivery tube with a static mixer or the like. The adhesive is generally flowable upon application, but quickly solidifies upon curing. The adhesive material 22 used in the walls 14, 16 may be the same or different from the adhesives 22 used in surface layers 28, 30, 32 and the additional adhesive 34. Upon curing (hardening) of the adhesive 22, the blocks 20 bind together. Subsequent courses of blocks 20 are positioned by applying a layer of the adhesive 22 to the exposed surfaces between the courses of blocks 20 and between the adjoining surfaces of blocks 20 within each subsequent course. Construction continues until the composite rear wall 14 reaches the roof 8 of the mine and spans the entire entry 4. An initial layer of additional adhesive 34 may be applied to the mine floor 6 with the first course of blocks 20 being positioned in this initial adhesive layer 22. Additional adhesive 34 may be injected at the roof 8 and pillars 10, 12 in order to achieve a complete fit of the composite rear wall 14 between all the mine entry 4 surfaces. A coating of adhesive (not shown) may be applied to the rear wall 14 to increase the strength of the rear wall 14. After the rear wall 14 is constructed, the first several courses of the front wall 16 are constructed in a similar manner as the rear wall 14, as well as the center portion of the front wall 16 which contacts the mine roof 8. Additional adhesive 34 may be inserted into gaps between the rear wall 14 and floor 6, roof 8 and pillars 10, 12.

The core member 18 is installed stepwise along with construction of the front wall 16. A layer of the aggregate material 26 is provided behind the partially constructed front wall 16 and the foamable polyurethane (or other binding material 24) is applied to the aggregate layer. As the polyurethane cures and foams, the aggregate material 26 moves therewith to fill the gap between the back and front walls 14, 16. Subsequent courses of the concrete blocks 20 are constructed and additional aggregate material 26 and binding material 24 are placed on top of the precedingly produced foamed polyurethane/aggregate layer between the two walls 14, 16 until the front wall 16 and core member 18 are completely constructed. Alternatively, the core member 18 may be constructed stepwise by applying layers of foamed polyurethane into the gap between the rear wall 14 and growing front wall 16 without the aggregate. The adhesive 22 may be applied to the backside of the front wall 16 as the first wall is constructed, creating surface layer 30, and/or may be applied to the exposed surface of the front wall 16 as front surface layer 32 for providing additional strength to the seal. The adhesive layers 28, 30 and 32, as well as additional adhesive 34 are used depending on the strength requirements for the seal 2. Finally, a fire-resistant sealant 36 is applied to the exposed surface of the front wall 16 or front surface layer 32.

Figure 5:
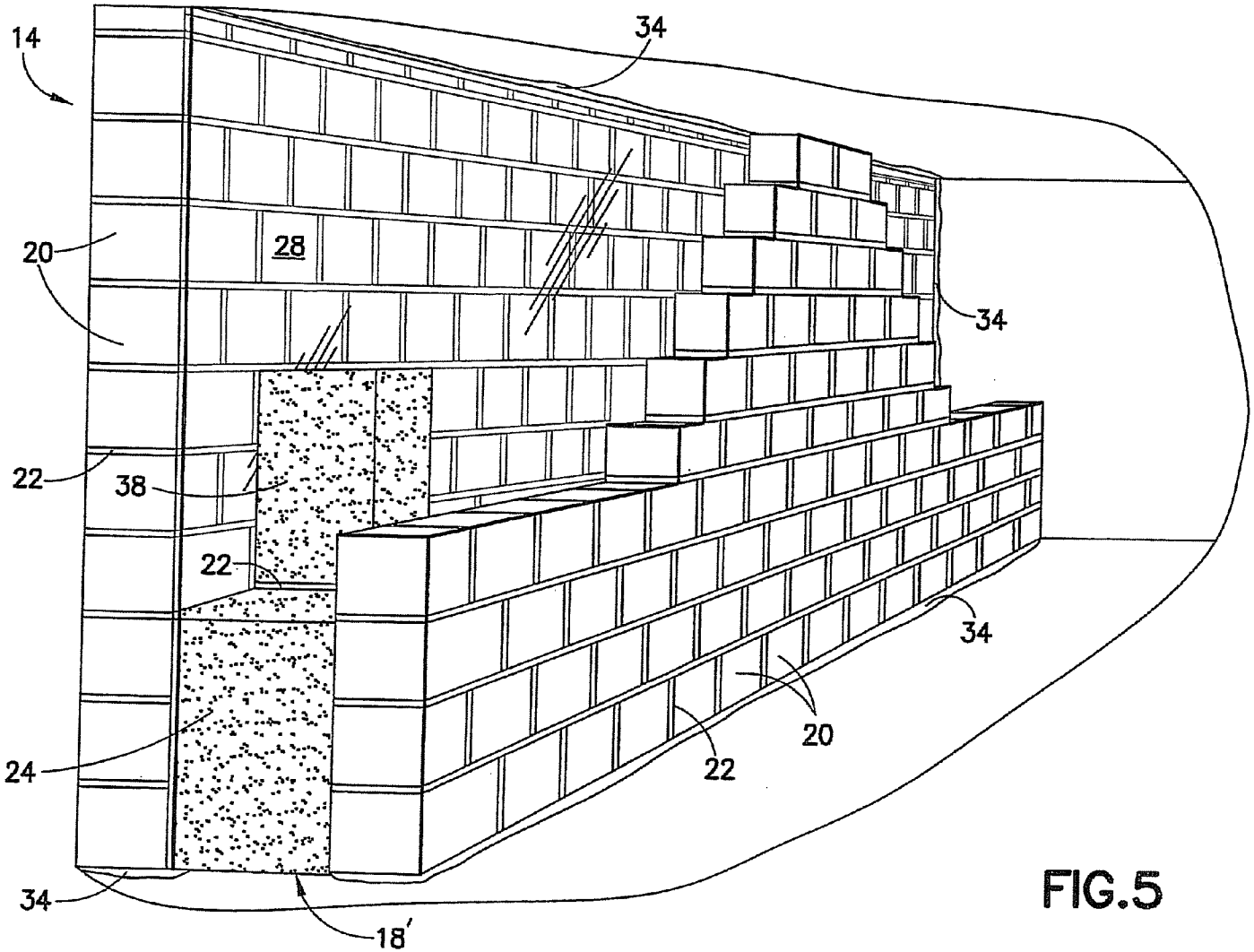
FIG. 5 is a perspective view of a second stage of constructing a mine seal according to one embodiment of the present invention.

In one embodiment of the present invention, shown in FIG. 5, a core member 18' between the two walls is provided as a plurality of blocks 38 produced from the binding material 24, such as a foamable polyurethane (e.g., RokLok® 10 available from Micon, Inc.). Other binding materials may be used, such as plastics, polymeric foams and synthetic foams. The plurality of blocks 38 may be precast above the ground and transported to the mine entry 4. Production of the blocks 38 above-ground also reduces exposure of personnel to chemicals and/or fumes that may occur when core member 18 is produced in situ in the closed environment of a mine entry. The blocks 38 may be checked for quality standards (e.g. as meeting a desired density for proper function in a seal) above ground in a controlled environment. The plurality of blocks 38 produced from the binding material 24 may also be sized and shaped to allow the blocks 38 to be efficiently carried and lifted by an installation worker. For example, blocks produced from a polyurethane having a density of about 12 pounds per cubic foot may be sized about 4 cubic feet and be handleable by an individual.

The plurality of blocks 38 may be installed stepwise along with construction of the front wall 16 as shown in FIG. 5 and described hereinabove with respect to FIGS. 3-4. The plurality of blocks 38 may also be installed prior to installation of the front wall 16. In either case, installation of the plurality of blocks 38 to form the core member 18' may be accomplished in a similar manner as described hereinabove with respect to installation of the concrete blocks 20. An initial layer of adhesive 34 may be applied to the mine floor 6 with the first course of blocks 38 being positioned in the initial adhesive layer 22. Subsequent courses of blocks 38 are positioned by applying a layer of the adhesive 22 to the exposed surfaces between the courses of blocks 38 and between the adjoining surfaces of blocks 38 within each subsequent course. Construction continues until the core member 18' reaches the roof 8 of the mine and spans the entire entry 4. Additional adhesive 34 may be injected at the roof 8 and pillars 10, 12 in order to achieve a complete fit of the core member 18' between all the mine entry 4 surfaces. In this manner, a core produced from blocks 38 adhered together creates a monolithic core structure, wherein the core produced from blocks 38 exhibits strength properties in excess of the strength of the individual blocks 38.

A monolithic core structure of the blocks 38 adhered together with adhesive 22 may be produced in a few hours (such as about 2 hours) as compared to production of conventional block seals produced from cementatious materials that may require up to several days to cure and be useable. Further, the blocks may be cut and shaped at the installation site to fit the mine entry 4. Foamable polyurethane creates heat as it cures and foams through an exothermic reaction. The heat from this reaction may cause certain safety concerns, such as an increased risk of a fire, in an underground mine environment. Thus, forming the core member 18' from the plurality of blocks 38 above ground minimizes the amount of heat created in an underground mine.

Figure 6:
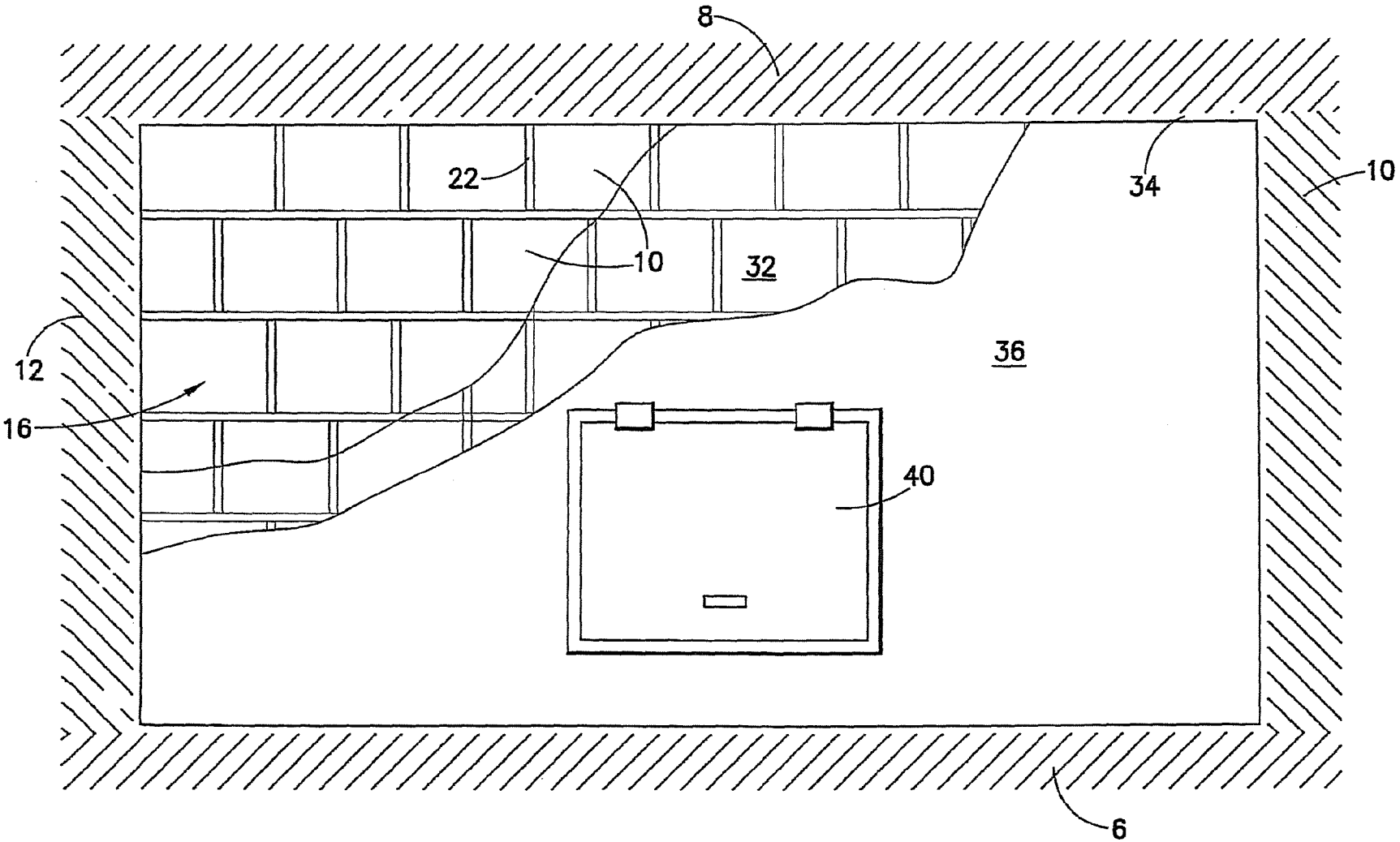
FIG. 6 is an elevational view of the front wall of a mine seal installed in a mine entry according to a further embodiment of the present invention.

In a further embodiment of the present invention, shown in FIG. 6, the mine seal 2 includes a closeable opening extending through the rear block wall 14, the front block wall 16, and the core member 18 or 18'. A pair of doors 40 may be positioned on the front block wall 16 and the rear block wall 14 to selectively allow access through the closable opening. The concrete blocks 20 may be used to form an arch or opening (not shown) that extends through the thickness of the mine seal 2. The door 40 may be a swinging-type man door, a guillotine-type man door or any other suitable type of door arrangement. The mine seal 2 may function as a ventilation seal when the seal 2 includes the closeable opening and doors 40 and may subsequently be converted to an explosion seal by removing the doors 40 and closing the opening using the plurality of blocks 20 and a core member 18 or 18' as described hereinabove.

The mine seal of the present invention provides a tight seal within the mine entry. The adhesive seals around the entire perimeter of the seal structure, thereby impeding movement of the mine atmosphere from one side of the seal to the other and increasing the integrity of the seal within the mine entry. It has been found that the mine seal of the present invention can withstand mine explosion overpressures of well in excess of 20 psi, such as in excess of 240 psi. The strength of the seal is partially a function of the adhesive material between the blocks, which greatly increases the strength of the block wall bound to the core member over prior seals. The adhesive material also has flexural properties, which allows the seal to better absorb energy and prevent the formation of cracks in the seal over prior seals. Further, the adhesive material does not shrink or degrade over time providing a longer life expectancy for the seal compared to prior seals formed with a cementitious material. Increased strength properties are achievable by coating the surfaces of the front and back walls with layers of the adhesive. In this manner, the strength of the seal may be selected depending on the particular conditions of a mine.

It should be appreciated that the composite wall of the present invention may also be used in the construction industry or the like, such as in foundations, dividing walls, or to provide damage resistance to extraneous explosions (i.e., as a security barrier). Instead of constructing block walls by dry stacking blocks or mortaring blocks, the adhesive used in the present invention creates composite block walls with strength properties heretofore unobtainable.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

The invention claimed is:

1. An explosion-resistant mine seal comprising:

a composite structure including a front wall and a back wall, each said wall spanning a mine entry and comprising a plurality of blocks and a non-cementatious adhesive provided between adjoining surfaces of said blocks, said adhesive having greater strength properties than said blocks; and a core member provided between said walls and adhering to said walls, wherein said composite structure withstands explosion overpressure in excess of 20 psi within the mine entry.

2. The mine seal of claim 1, further comprising a coating of an adhesive provided on a side of at least one of said walls facing said core member.

3. The mine seal of claim 2, further comprising a coating of an adhesive provided on an exposed side of said front wall.

4. The mine seal of claim 1, wherein said adhesive comprises polyurethane.

5. The mine seal of claim 1, wherein said blocks comprise concrete blocks.

6. The mine seal of claim 1, wherein said core member comprises a foamed polymeric material and aggregate material.

7. The mine seal of claim 6, wherein said foamed polymeric material comprises polyurethane.

8. The mine seal of claim 1, wherein said core member comprises a plurality of blocks formed from a foamed polymeric material.

9. The mine seal of claim 8, wherein the adhesive is provided between adjoining surfaces of said block formed from the foamed polymeric material.

10. The mine seal of claim 1, further comprising a closeable opening extending through the front wall, the back wall, and the core member.

11. The mine seal of claim 1, further comprising at least one interior wall provided between the front and back wall.

12. In a mine seal comprising a pair of block walls and a core member provided therebetween and adhering to said walls, the improvement comprising:

providing a non-cementatious adhesive between adjoining surfaces of the blocks in said walls that span a mine entry, wherein said adhesive has greater strength properties than the blocks, that said mine seal withstands explosion overpressure in excess of 20 psi within the mine entry.

13. The mine seal of claim 12, wherein the strength properties include compressive strength, flexural strength, shear strength and tensile strength.

14. The mine seal of claim 12, wherein the blocks comprise concrete blocks.

15. The mine seal of claim 14, wherein said adhesive comprises polyurethane.

16. The mine seal of claim 12, wherein said core member comprises a plurality of blocks formed from a foamed polymeric material.

17. The mine seal of claim 16, wherein the adhesive is provided between adjoining surfaces of said block formed from the foamed polymeric material.

18. A method of strengthening a wall in an explosion-resistant mine seal comprising a plurality of blocks, the method comprising:

providing a plurality of individual blocks;

coating a surface of each block with a non-cementatious adhesive; and stacking the blocks to form a wall spanning a mine entry, with the adhesive being positioned between adjoining surfaces of the blocks, wherein the adhesive has greater strength properties than the individual blocks such that the seal withstands explosion overpressure in excess of 20 psi.

19. The method of claim 18, further comprising coating the wall with the adhesive.

20. The method of claim 18, wherein the blocks comprise masonry blocks.

21. The method of claim 20, wherein the blocks comprise concrete blocks and the adhesive comprises polyurethane.

22. The method of claim 18, wherein the adhesive is further coated onto surfaces of the blocks, such that the adhesive adheres to the mine entry.

23. The method of claim 18, wherein the mine seal comprises a pair of block walls and a core member provided therebetween and adherent to the block walls.

24. The method of claim 23, further comprising a closeable opening extending through the pair of block walls and the core member.

25. The method of claim 24, wherein the adhesive is provided between adjoining surfaces of said block formed from the foamed polymeric material.

26. The method of claim 23, wherein said core member comprises a plurality of blocks formed from a foamed polymeric material.

27. An explosion-resistant mine seal comprising:

a composite structure including a front wall and a back wall, each said wall spanning a mine entry and comprising a plurality of blocks and an adhesive provided between adjoining surfaces of said blocks, said adhesive having greater strength properties than said blocks; and a core member provided between said walls and adhering to said walls, wherein said composite structure withstands explosion overpressure in excess of 240 psi.

28. In a mine seal comprising a pair of block walls and a core member provided therebetween and adhering to said walls, the improvement comprising:

providing an adhesive between adjoining surfaces of the blocks in said walls that span a mine entry, wherein said adhesive has greater strength properties than the blocks, wherein the mine seal withstands explosion overpressure in excess of 240 psi.

29. A method of strengthening a wall in an explosion-resistant mine seal comprising a plurality of blocks, the method comprising:

providing a plurality of individual blocks;

coating a surface of each block with an adhesive; and stacking the blocks to form a wall spanning a mine entry, with the adhesive being positioned between adjoining surfaces of the blocks, wherein the seal withstands explosion overpressure in excess of 240 psi.

* * * * *